US005806839A

United States Patent [19]

Meglino

[11] Patent Number: 5,806,839

[45] **Date of Patent: *Sep. 15, 1998**

[54] PRIVACY INSERTS FOR CHAIN LINK FENCES HAVING OVERLAPPING PORTIONS

[76] Inventor: Don A. Meglino, 13 Mott Pl., Glenwood Landing, N.Y. 11547

[ * ] Notice: The term of this patent shall not extend beyond the expiration date of Pat. No. 5,584,468.

[21] Appl. No.: 914,359

[22] Filed: Aug. 19, 1997

Related U.S. Application Data

[63] Continuation of Ser. No. 680,882, Jul. 16, 1996, abandoned, which is a continuation of Ser. No. 333,033, Nov. 1, 1994, abandoned.

[51] Int. Cl.[6] ..... B21F 27/00

[52] U.S. Cl. ..... 256/34; 256/1

[58] Field of Search ..... 256/32, 34, 1, 256/45, 47, 48, 49, 50

[56] References Cited

U.S. PATENT DOCUMENTS

| | | | |
|---|---|---|---|
| 4,860,998 | 8/1989 | Snyder | 256/34 |
| 5,007,619 | 4/1991 | Sibeni | 256/34 |
| 5,056,761 | 10/1991 | Meglino et al. | 256/34 |
| 5,106,058 | 4/1992 | Finkelstein | 256/34 |
| 5,184,801 | 2/1993 | Finkelstein | 256/34 |
| 5,275,381 | 1/1994 | Cluff et al. | 256/34 X |
| 5,584,468 | 12/1996 | Meglino et al. | 256/34 |

*Primary Examiner*—Daniel P. Stodola
*Assistant Examiner*—Bruce A. Lev
*Attorney, Agent, or Firm*—Galgano & Burke

[57] ABSTRACT

Privacy slats for chain link fences and a system comprising a chain link fence and a plurality of slats wherein portions of slats which are positioned substantially parallel are disposed in overlapping arrangement. One embodiment comprises a plurality of slats having a central, substantially tubular section with opposing wings positioned in an offset manner such that the wing on one side of the central tubular portion is disposed more forwardly of the wing on the opposing side of the central tubular portion.

27 Claims, 2 Drawing Sheets

PRIVACY INSERTS FOR CHAIN LINK FENCES HAVING OVERLAPPING PORTIONS

This is a continuation of application Ser. No. 08/680,882, filed Jul. 16, 1996, now abandoned, which is a continuation of application Ser. No. 08/333,033, filed Nov. 1, 1994, now abandoned.

The present invention is directed to privacy inserts for chain link fences and, more particularly, to fence inserts having overlapping portions.

BACKGROUND OF THE INVENTION

Chain link fences have been widely used for many years to satisfy fencing requirements. While they provide acceptable strength and durability over many years, they do not provide privacy or serve as a windbreak due to their appertured construction. Various inserts, typically referred to as "slats", have been suggested and manufactured for increasing the privacy of a chain link fence, as well as serving as a windbreak. Many early arrangements were designed to be directly connected to the wire of the fence and required clamping or bending of a metal slat onto a link of the fence.

The inventor of the present invention overcame a problem with slats migrating upwardly and downwardly due to wind or other environmental forces, which created an unfinished uneven appearance, by providing a slat retaining means which extended through a slot in the slats and is described in U.S. Pat. No. 4,512,556 to Meglino which issued on Apr. 23, 1985.

While a wide variety of privacy slats have been suggested, the various configurations widely used today typically provide slats extending in the same direction disposed in a spaced, or at best an abutting, arrangement. Due to imperfections in manufacture and the inherent design of chain link fences which have a "knuckle" formed where individual strands of the chain link fence meet, previously suggested designs leave gaps between the slats. Since the ultimate design of such slats is to maximize privacy, it is highly desirable to provide a fence slat system which greatly minimizes the gaps between adjoining slats.

It is also highly desirable to provide a privacy slat system which is easy to install while enhancing the privacy characteristics of the fence.

SUMMARY OF THE INVENTION

The various embodiments of the present invention provide a plurality of privacy slats for chain link fences and a system comprising a chain link fence and a plurality of slats wherein portions of slats, which are positioned substantially parallel, are disposed in overlapping arrangement.

One embodiment of the present invention comprises a plurality of slats having a central, substantially tubular section with laterally extending wings. According to one preferred embodiment of the present invention, the opposing wings are positioned in an offset manner such that the wing on one side of the central tubular portion is disposed more forwardly of the wing on the opposing side of the central tubular portion.

According to another preferred embodiment of the present invention, the opposing wings on a slat are formed in a substantially triangular shape. According to another embodiment of the present invention, laterally extending wings of a slat are offset and provided with slits in order to facilitate insertion of the slat into a chain link fence.

According to another embodiment of the present invention, each slat is provided with more than two, opposing wings. For example, one side of the slat is provided with two laterally extending wings while the other side is provided with a single, laterally extending wing.

These and other embodiments of the present invention are described below with reference to the Figures.

DETAILED DESCRIPTION

The various embodiments of the present invention are directed to systems for enhancing the privacy provided by a chain link fence, and to slats useful in enhancing the privacy of chain link fences by providing side portions disposed in substantially overlapping arrangement for adjoining slats which have substantially parallel longitudinal axes.

Figure 1:
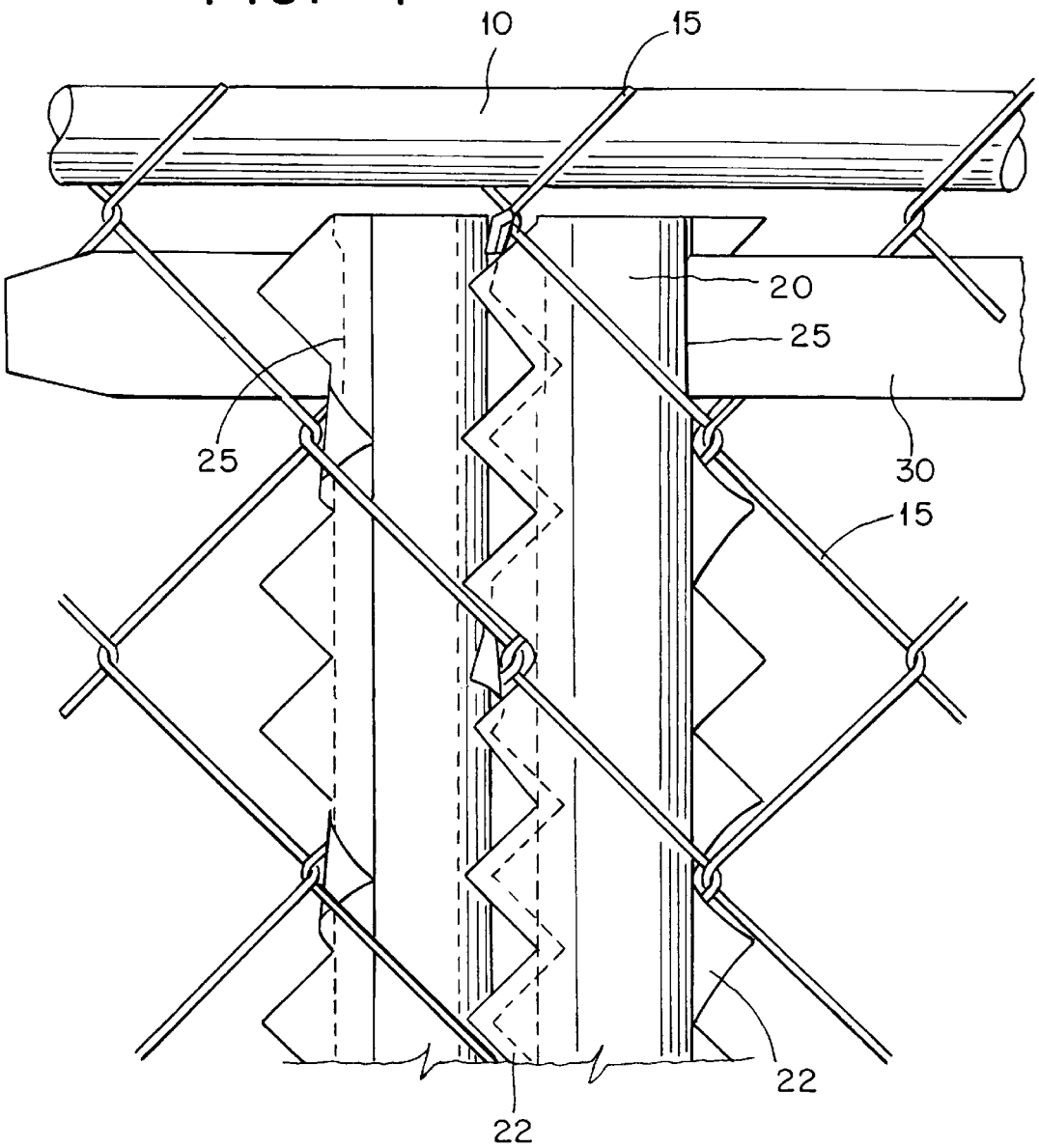
FIG. 1 is a perspective view of one embodiment of the present invention.

FIG. 1 illustrates one preferred embodiment of the present invention wherein a fence assembly comprises a slat assembly positioned within a chain link fence comprising a support bar 10 and interwoven links 15. According to this embodiment of the present invention, the slats comprise a tubular center portion 20 having a generally elliptical cross-section and opposing slots 25 for receiving a retaining bar 30. Each slat also advantageously comprises two opposing wing members 22 which extend laterally. The wing members 22 of this embodiment of the present invention are advantageously shaped with offset generally triangular serrated portions which are large enough to overlap with the serrated portions of adjoining slats in order to substantially eliminate the space between adjoining center portions 20.

Figure 2:
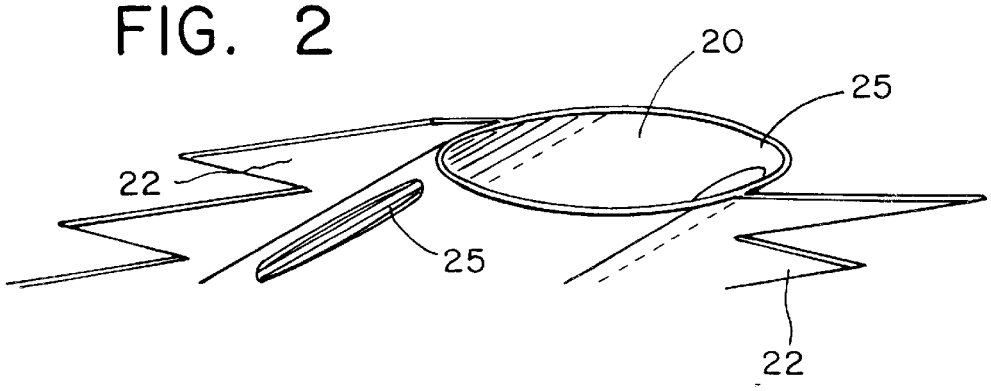
FIG. 2 is a perspective, end view of a fence slat shown in the embodiment of FIG. 1.
Figure 3:
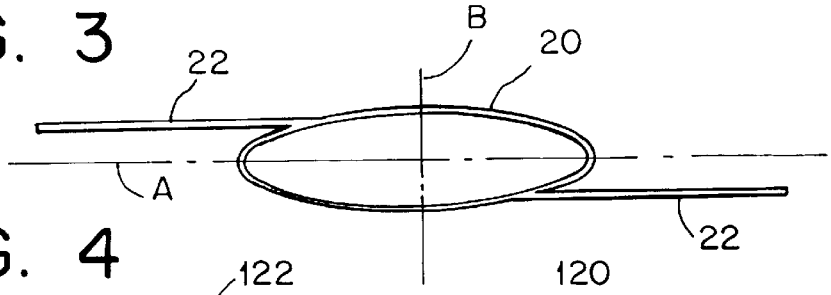
FIG. 3 is a cross-sectional view of the slat shown in FIG. 2.

As shown more clearly in FIGS. 2 and 3, opposing wing members 22 of a slat of this embodiment of the present invention are offset so that one wing member is disposed more forwardly than the opposing wing member. In this manner, wing members of neighboring slats are less likely to abut along their edges and will more readily overlap without interfering with each other. As shown in FIG. 3, according to this preferred embodiment of the present invention, the opposing wing members extend outwardly from the generally tubular central portion 20 at a position between the center and forward/rearward sides of the central tubular portion 20.

In the illustrated cross-sectional view of the fence slat shown in FIG. 3, tubular central portion 20 includes a major axis A and a minor axis B. As used herein, "major axis" is meant to define a line generally along the length of the cross-section of the body member. As used herein, "minor axis" is meant to define a line generally across the width of the cross-section of the body member and which is perpendicular to the major axis.

Figure 4:
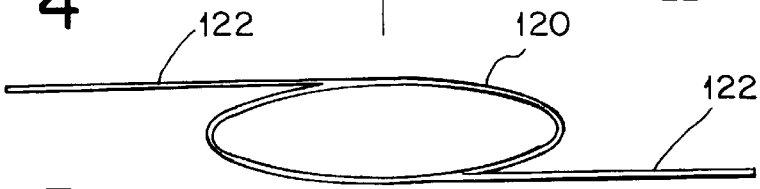
FIG. 4 is a cross-sectional view of a slat of an alternative embodiment of the present invention.

According to a further embodiment of the present invention illustrated in FIG. 4, laterally, opposing wing members 122 are formed essentially along imaginary lines tangent to the forward and rearward sides of a central, tubular portion 120. In this embodiment of the present invention, the wing members of neighboring slats will be positioned slightly further apart and therefore have even less of a tendency to abut after insertion into a chain link fence.

Figure 5:
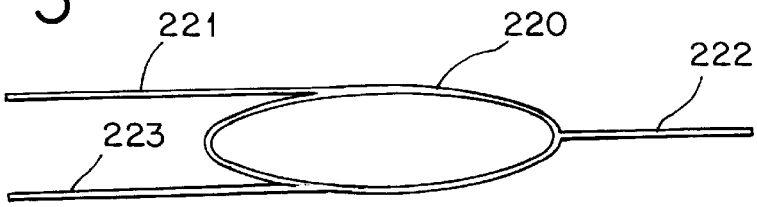
FIG. 5 is a cross-sectional view of another embodiment of the present invention.

A still further embodiment of present invention is illustrated in FIG. 5 wherein a rearward wing member 221 and a forward wing member 223 are disposed on one side of a central, generally-tubular member 220 and an opposing wing member 222 is positioned on the opposite side of the central member 220 at a position offset from rearward wing member 221 and forward wing member 223. In this illustrated embodiment, wing member 222 is advantageously positioned generally centrally between the forward and rearward sides of central member 220 so that wing member 222 will extend between the forward wing member 223 and rearward wing member 221 of an adjoining slat. While the wing members of this embodiment of the present invention, as well as those of the other illustrated embodiments, extend away approximately equal distances from the central tubular portion 220, it is within the scope of the present invention to form projecting side portions having different lengths.

The illustrated embodiment of FIG. 5 provides a more complete overlapping of adjacent fence slats, and thus, provides more privacy. In particular, the wing members of FIG. 5 eliminate the ability of an observer to see through the fence slats when sighting along the fence at an angle.

The illustrated embodiments comprise substantially tubular central portions having generally elliptical cross-sections. While this shape is presently believed to be the preferred configuration, a generally tubular central portion is not necessary in order to enjoy the advantages of the present invention which can be realized with tubular central portions having cross-sections of different shapes, as well as central portions which are non-tubular. It is presently believed that the illustrated shape is preferred since a tubular shape has inherent resiliency which helps to maintain the slats in position after they are inserted into a chain link fence. The illustrated shape also advantageously provides the same appearance on both sides of the fence and fills substantially the entire opening formed by the links thereby avoiding rattling of the slots during windy conditions.

Figure 6:
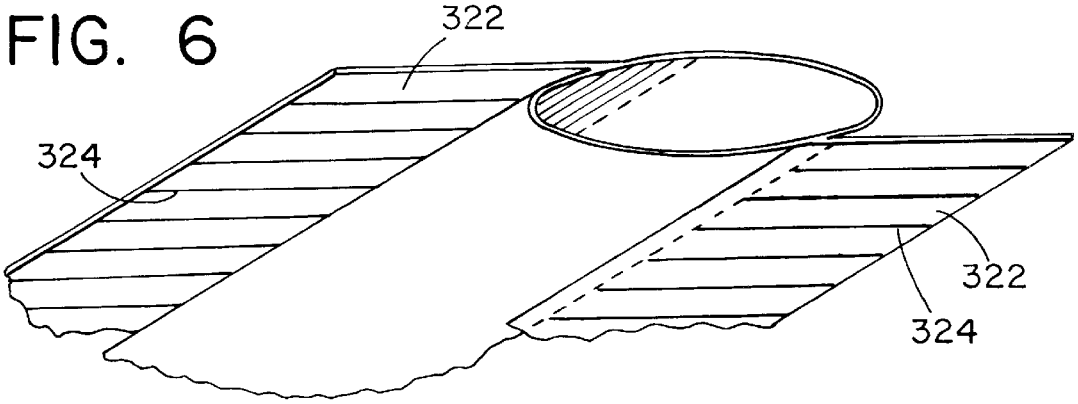
FIG. 6 is a perspective, end view of a further embodiment of the present invention.
Figure 7:
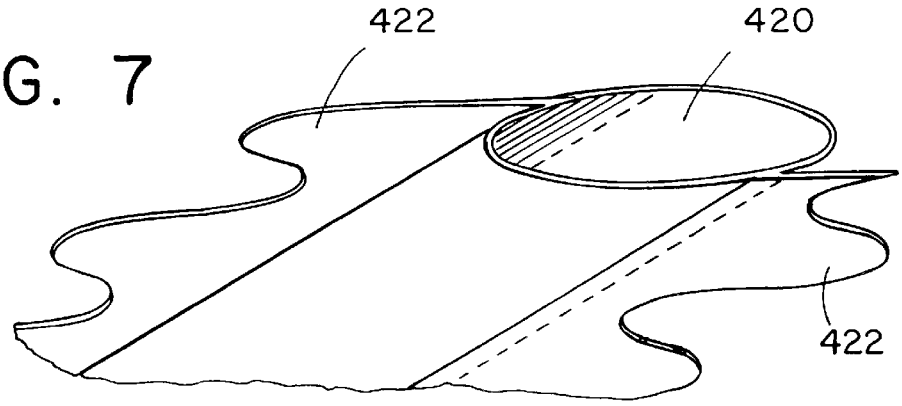
FIG. 7 is a further perspective, end view of a still further embodiment of the present invention.

FIGS. 6 and 7 illustrate still further embodiments of the present invention. In FIG. 6, the opposing, offset, lateral wings are provided with spaced slits 324. Those skilled in the art will appreciate that the slits 324 in lateral wings 322 will facilitate the insertion of this slat into a chain link fence by reducing the resistance of the wings to bending. The embodiment of the present invention illustrated in FIG. 7 comprises a central tubular portion 420 and curved opposing laterally offset wings 422. The curved wings 422 are of a generally scalloped-shape which facilitates insertion of the slat as it is inserted downwardly into a chain link fence. While the embodiments shown in FIG. 6 and 7 do not comprise slots for receiving a retaining member, it will also be appreciated that a retaining member can be used with any one of these or other embodiments of the present invention.

What is claimed is:

1. A slat assembly for use with a fence of the type having a substantially planar portion and linking wires which form knuckles and define a plurality of slat receiving channels therebetween, comprising:

a plurality of slats adapted to be disposed in substantially parallel relation within adjacent channels of a chain link fence, each of said slats comprising:

a first body member comprising a cross-section having a major axis which is substantially co-planar with the planar fence portion of the fence and a minor axis; and a first side member and a second side member extending substantially laterally from and integral with said first body member and terminating respectively at different offset first and second locations relative to said major axis, and wherein said side members terminate on opposite sides of said major axis.

2. A slat assembly according to claim 1 wherein at least one of said side portions comprises a non-linear edge.

3. A slat assembly according to claim 2 wherein said non-linear edge comprises substantially triangular portions.

4. A slat assembly according to claim 2 wherein said non-linear edge comprises curved portions.

5. A slat assembly according to claim 1 wherein at least one of said side portions comprises a plurality of spaced slits.

6. A slat assembly according to claim 1 wherein at least one of said slats comprises more than two opposing side portions.

7. A slat assembly according to claim 1 wherein said first member comprises a generally hollow body.

8. A slat assembly according to claim 1 wherein said first member has a generally elliptical cross-section.

9. A slat assembly according to claim 1 wherein said slat assembly further comprises means for retaining said slats in said fence, and wherein said retaining means are disposed in contact with a plurality of said slats.

10. A slat assembly according to claim 9 wherein said retaining means extends through at least a portion of a plurality of said slats.

11. A slat assembly according to claim 1 wherein said side members terminate at different distances from said major axis.

12. A slat assembly according to claim 1 wherein said side members are dimensioned so that at least a portion of said side members, when disposed in a fence, overlap at least a portion of a side member of an adjacent slat.

13. A slat assembly according to claim 1 wherein said major axis coincides with the central plane of a fence when said slat is inserted therein.

14. A slat assembly according to claim 13 wherein said side members terminate at different distances from said major axis.

15. A fence slat for use with a fence of the type having a substantially planar portion and linking wires which form knuckles and define a plurality of slat receiving channels therebetween, said slat comprising:

a first body member comprising a cross-section having a major axis which adapted to be disposed substantially co-planar with said planar fence portion of the fence and a minor axis; and a first side member and a second side member extending substantially laterally from and integral with said first body member and terminating respectively at different offset first and second locations relative to said major axis, and said side members terminating on opposite sides of said major axis, and wherein said slat is insertable within a channel of the fence.

16. A fence slat according to claim 15 wherein at least one said side members comprises a non-linear edge.

17. A fence slat according to claim 16 wherein said non-linear edge comprises substantially serrated portions.

18. A fence slat according to claim 16 wherein said non-linear edge comprises curved portions.

19. A fence slat according to claim 15 wherein at least one of said side members comprises a plurality of spaced slits.

20. A fence slat according to claim 15 further comprising a third side member.

21. A fence slat according to claim 15 wherein said first member comprises a substantially hollow configuration.

22. A fence slat according to claim 15 wherein said side members terminate at different distances from said major axis.

23. A fence slat according to claim 15 wherein said side members terminate on opposite sides of said major axis.

24. A slat assembly according to claim 15 wherein said side members are dimensioned so that at least a portion of said side members, when disposed in a fence, overlap at least a portion of a side member of an adjacent fence slat.

25. A fence slat according to claim 15 wherein said major axis coincides with the central plane of a fence when said slat is inserted therein.

26. A slat assembly according to claim 25 wherein said side members terminate at different distances from said major axis.

27. A slat assembly according to claim 25 wherein said side members terminate on opposite sides of said major axis.

* * * * *